United States Patent [19]

Nomura

[11] Patent Number: 4,706,396

[45] Date of Patent: Nov. 17, 1987

[54] FILE

[75] Inventor: Tetsuro Nomura, Osaka, Japan

[73] Assignee: Sanki Vinyl Kabushiki Kaisha, Osaka, Japan

[21] Appl. No.: 798,250

[22] PCT Filed: Mar. 22, 1985

[86] PCT No.: PCT/JP85/00142

§ 371 Date: Nov. 4, 1985

§ 102(e) Date: Nov. 4, 1985

[87] PCT Pub. No.: WO85/04373

PCT Pub. Date: Oct. 10, 1985

[30] Foreign Application Priority Data

Mar. 24, 1984 [JP] Japan ..... 59-42487
Jul. 13, 1984 [JP] Japan ..... 59-106599

[51] Int. Cl.[4] ..... G09F 1/10

[52] U.S. Cl. ..... 40/124.2; 40/359; 40/530

[58] Field of Search ..... 40/124, 124.2, 530, 40/534, 388; 206/45.11; 150/147

[56] References Cited

U.S. PATENT DOCUMENTS

| | | | |
|---|---|---|---|
| 328,161 | 10/1885 | Watson | 40/530 |
| 812,515 | 2/1906 | Munster | 40/530 |
| 1,415,429 | 5/1922 | Cueny | 40/530 |
| 1,604,028 | 10/1926 | Dinkler | 40/534 |
| 4,004,690 | 1/1977 | Giarritta | 150/147 |
| 4,441,270 | 4/1984 | Crowell et al. | 40/530 |

*Primary Examiner*—Gene Mancene
*Assistant Examiner*—Wenceslao J. Contreras
*Attorney, Agent, or Firm*—Koda and Androlia

[57] ABSTRACT

The file is equipped with a plurality of bags, which are vertically stacked, between the front cover and the back cover being unfoldable. The vertically adjoining bags are connected by way of the connecting part one to another and the upper bags can be shifted from the lower bags in the direction opposite to the opening section within the allowable range of the connecting part so that the opening section of the lower bags may be exposed from the upper bags. The knob is provided on the uppermost bag.

7 Claims, 15 Drawing Figures

FIG. 6
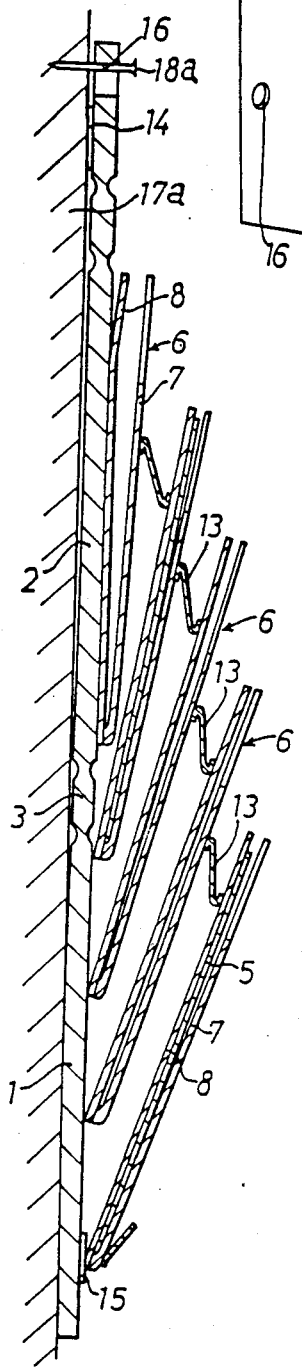
FIG. 1
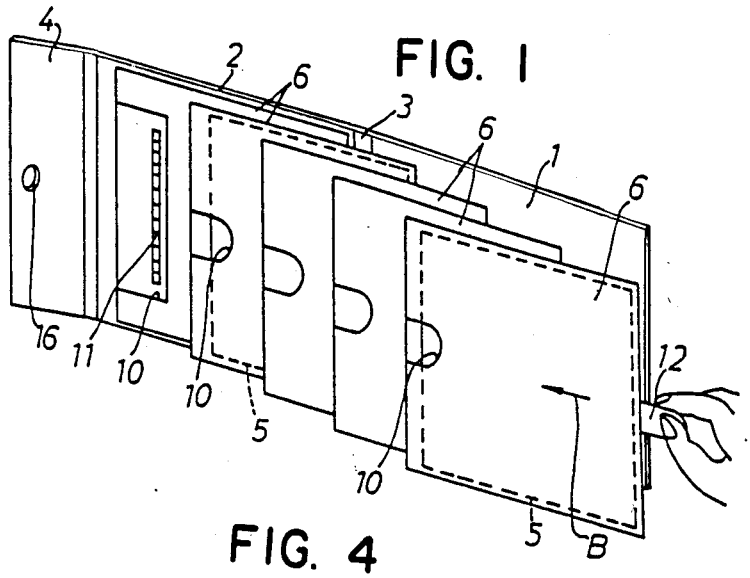
FIG. 4
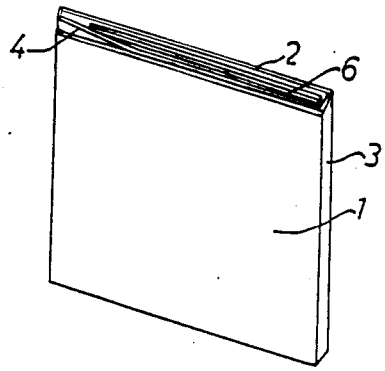
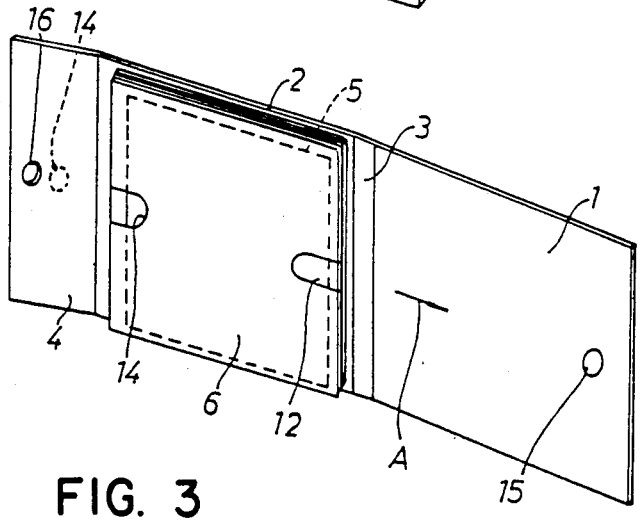
FIG. 3

C

FILE

TECHNICAL FIELD

The present invention relates to a file enclosing and storing sheetlike articles to be enclosed such as a magnetic disk, document and the like in an overlapping manner.

BACKGROUND ART

When enclosing the sheetlike articles to be enclosed such as the magnetic disk, the document and the like, the file, hitherto used, is vertically equipped with a plurality of stack of bags between a front cover and a back cover which can be opened and closed.

Conventionally, such a file has had each of ends of a plurality of backs bound to the backbone thereof. In that case, however, in order to retrieve any of the articles to be enclosed in the bags, it is needed to turn over one by one these bags, resulting in an apprehesion that, in addition to take much time for the retrieval, an unavoidance of folding the articles to be enclosed deforms them. In particular, with the magnetic disk which has recently been spreaded for common use, there is a necessity of preventing it from being folded and deformed.

From that view, the file, wherein a stack of bags are connected one to another such that each of them is shifted by a fixed distance, whereby the articles to be enclosed can be also shifted, when being enclosed, is available for use. Although such a type of file does not need to turn over the bags, when making the retrieval, an inability of folding up the file may make the same large-sized proportionally to increase the number of the bags so that it is not suitable for enclosing a great number of articles to be enclosed.

The purpose of the invention, which is made in terms of the aforementioned points, is to provide the file capable not only of retrieving easily the articles to be enclosed without giving a damage to them but of enclosing a majority of them in a compact manner.

DISCLOSURE OF THE INVENTION

The present invention adapts the file being vertically equipped with a plurality of stack of bags for enclosing the sheetlike articles to be enclosed such that they can be freely taken in and out between the front cover and the back cover which are unfoldable to employ the structure in which, in order to make optionally a positional change from the point of view of the positions at which bags being adjoined one to another are vertically stacked as well as the positions at which, in order that the opening sections of the lower bags are exposed from the upper bags, the upper bags are shifted with respect to the lower bags in a direction opposite to the opening sections, the bags being adjoined one to another are coupled by way of connection parts one to another, the lowest bag is mounted to the side of the back cover, and a knob for pulling out the uppermost bag in a direction opposite to the opening section is provided on the uppermost bag.

The retrieval of the articles to be enclosed is easily facilitated, if the knob, being grasped, is pulled out in a direction opposite to the opening section, because it causes the bags to be shifted one from another such that the opening sections of the lower bags are exposed. Furthermore, for the purpose of storing the articles to be enclosed after the retrieval, all the requirements are only to stack the bags, the operation of which may attain a compact stack of the bags.

BRIEF DESCRIPTION OF THE DRAWINGS

FIGS. 1 to 6 are illustrated examples of the first embodiment according to the present invention, in which FIG. 1 is a perspective view of the state where the file is unfolded;

FIG. 2 is an expanded sectional view of the principal section;

FIG. 3 is a perspective view of the state where the bags are stacked;

FIG. 4 is a perspective view of the state where the file is closed;

FIG. 5 is a outline view taken on an arrow C of FIG. 2;

FIG. 6 is a sectional view of the state where the file is hung.

FIG. 7 is a sectional view of the principal section of the second embodiment.

FIGS. 9 to 12 are illustrated examples of the fourth embodiment, in which FIG. 9 is a perspective view of the state where the file is unfolded;

FIG. 10 is a perspective view of the state where the bags are stacked;

FIG. 11 is an expanded sectional view of the principal section;

FIG. 12 is a partially enlarged view of FIG. 11.

FIG. 14 is a sectional view of the sixth embodiment, and

BEST MODE FOR CARRYING OUT THE INVENTION

Figures 2, 5, 7:
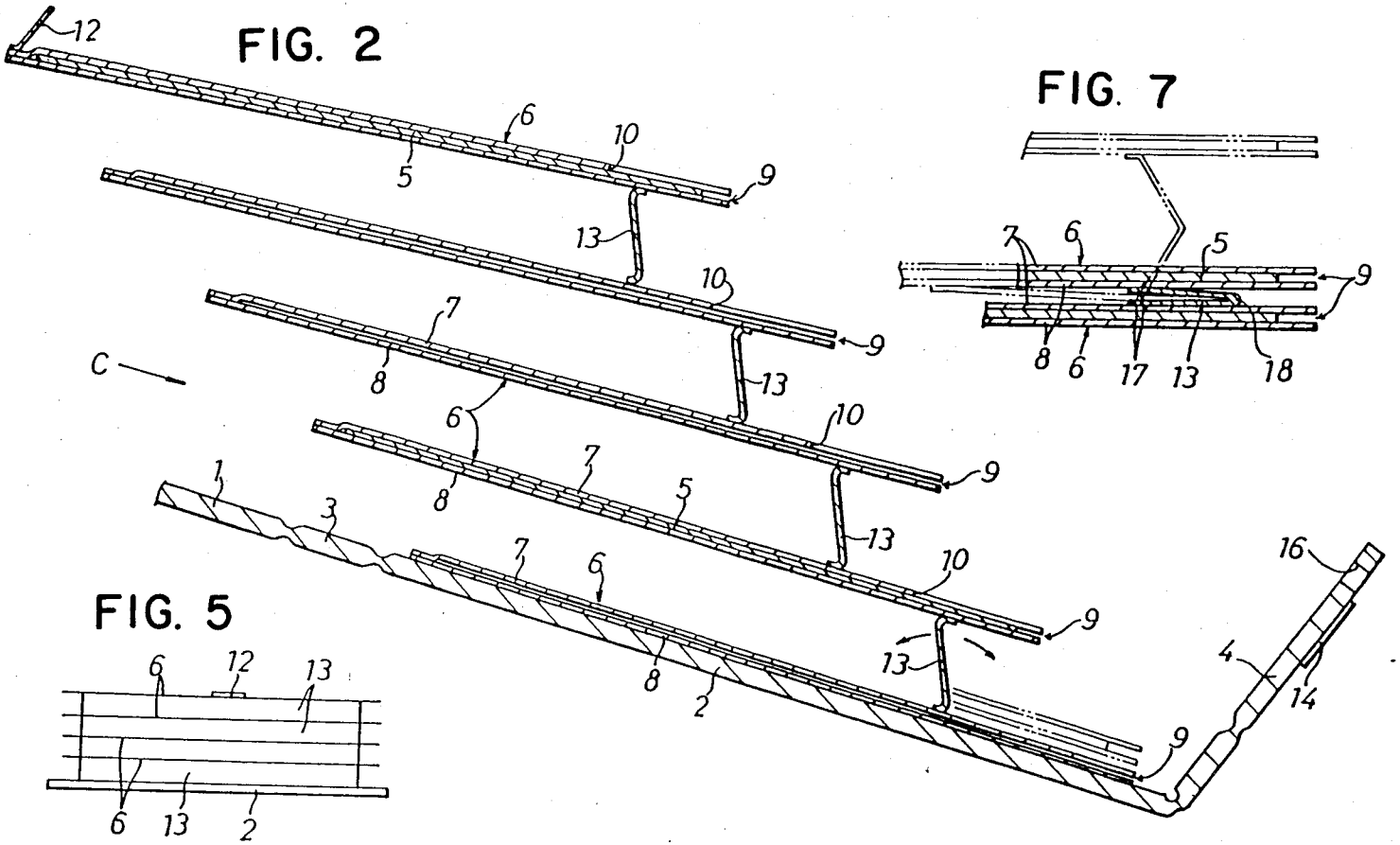

A detailed description of the illustrated embodiment according to the present invention is made as follows:

Referring first to FIGS. 1 to 6 which illustrate the first embodiment according to the present invention, 1 is the front cover, 2 is the back cover, these covers are connected by way of the backbone 3 to each other in an unfoldable manner, and an unfoldable press part 4 is connected to the back cover 2. 5 is the sheetlike article to be enclosed such that the magnetic disk. 6 is the bags for enclosing the article to be enclosed, 5 sheets of such stacked bags, rectangles of the same dimension, are put one upon another in a vertical manner, and the lowest bag 6 among them is combined with the back cover 2. Each of the bags 6 is constructed to have their three sides comprising a front sheet material 7 and a back sheet material 8, made of synthetic resin, being soft or having a retentionability of their own shape, combined with one another by being welded, the remaining side acting as the opening section into and out of which the article to be enclosed 5 can be taken. If the article to be enclosed 5 is the magnetic disk, it is preferable to mix the resin material of which the sheet materials 7 and 8 are made with an antistatic agent. A notch part 10, which notches the front sheet material 7, is formed on the side of the opening section 9 of each of the bags 6, whereby the article to be enclosed 5 can be easily taken in and out or an index of the article to be enclosed 5 can be also easily discerned. Notching the notched part 10 of the lowest bag 6 to larger extent than the notched part 10 of the adjoining upper bag causes the back sheet material 8 to be exposed so that its lower surface is adapted to be the part to be welded 11 to the back cover 2, thereby facilitating an insertion of the article to be enclosed 5 by hooking fingers on the opening section 9. The knob 12 for pulling out the bag 6 in a direction opposite to the opening section is mounted to the end edge, located to the side opposite to the opening section, of the uppermost bag 6.

13 is the rectangular connecting part, comprising the sheet material made of the synthetic resin identical in quality to the sheet materials 7 and 8 of the bag 6 or having a flexibility softer than that of aforementioned sheet materials 7 and 8, by way of which the bags 6 being vertically adjoined one to another are connected to one another. Namely, one end of the connecting part 13 is welded to be connected to the back sheet material 8 of the upper bag 6 such that it is located in proximity of the opening section 9 as well as it is in parallel with the opening section 9, whereas another end thereof is welded to be connected to the front sheet material 7 of the lower bag 6 such that it is positioned to be distant from the afore-mentioned place of connecting the former end to the upper bag 6 by a portion equal to the width of the connecting part 13 and to come near to the side opposite to the opening section, being in parallel with the opening section 9. For this reason, the positional change can be freely made between the positions at which the upper and lower bags 6 are vertically stacked and the positions at which, in order that the opening sections of the lower bags 6 are exposed from the upper bags 6, the upper bags 6 are shifted from the lower bags 6 in the direction opposite to the opening section. In that case, the upper bags 6 are adapted to be shifted to the side of the unfolded front cover 1. It is acceptable to use such a member as a hinge for the connecting part 13. Furthermore, Limiting the place of combining the connecting part 13 with the bag 6 to the proximity of the opening section 9 is not always all the requirements, and an acceptable point is that such a place is located to be nearer the opening section 9 than the intermediate position between the opening section 9 and the side opposite to the opening section. Such an alternative idea of forming integrally the connecting part 13 and the bag 6 may be also practically allowed. 14 and 15 are surface fasteners, among which the surface fastener 14 is provided on the presser 4, while the surface fastener 15 is provided on the front cover 1, and, when folding both the covers, the afore-mentioned fasteners are adapted to suspend the same. 16 is a hook portion, provided on the presser 4 on the side of the back cover 2, which is capable of being hung on a nail and the like.

The file having the afore-mentioned construction permits the fasteners 14 and 15 to be held in each other, when folding the front cover 1 and the back cover 2 and subsequently overlapping the end part of the front cover 1 and the presser 4, and, as shown in FIG. 4, the state where the bags 6 are covered with both the covers takes place, thereby being extremely convenient at the storage of the bags 6.

When taking the article to be enclosed 5 in and out the bag 6, first, being held in each other of the surface fasteners 14 and 15 is released, as shown in FIG. 3, the front cover 1 is unfolded, the knob 12, provided on the uppermost bag 6, is grasped, and it is pulled out in an arrow direction of FIG. 3, i.e. toward the side of the front cover 1. Since the connecting parts 13 between the bags 6 are then extended from their folded state, as shown in FIG. 1, the bags 6 are unfolded until the state where they are slightly shifted to the side of the front cover 1 within the allowable range of the connecting part 13 so that the opening section 9 and the notched part 10 of the lower bags 6 may be exposed. For this reason, that makes a visual observation of the opening section 9 and the notched part 10 of the bags 6 from the upper outside possible, whereby such a turning-over one by one the articles to be enclosed 5 at the retrieval as conventionally needed gets unnecessary, the retrieving time is extremely reduced, and there is no apprehesion of folding and deforming the articles to be enclosed 5.

When folding the bags 6, if the knob 12, while being grasped, is pushed in in an arrow direction of FIG. 1, it enables easily the bags 6 to be replaced to the state of being stacked. In that case, a option of moving the uppermost bag 6 nearer to the arrow direction B, while grasping the bag 6, is also acceptable.

Next, as shown in FIG. 6, if the file is hung down by inserting the hook portion 16 around the nail **18*a* striken on a wall 17*a*, the bags 6 are shifted down due to the gravity. At that time, since the place of combining the connecting part 13 with the bag 6 comes from the intermediate position between the opening section 9 and the side opposite to the opening section nearer to the opening section 9, it is avoided that the end edge of the opening section 9 dangles so that there takes place a difficulty in inserting the article to be enclosed 5 into the bag 6**, thereby attaining such a convenience that the file can be used, while being hung to the wall and the like.

FIG. 7 illustrate the second embodiment of the present invention. As the connecting part 13, in place of the soft sheet material, the sheet material which can retain its shape to same extent is used, at the time of which it is acceptably provided with inflextion portions 17 and 18 on its three points such as the parts near to the bag 6 and the intermediate point.

Figure 8:
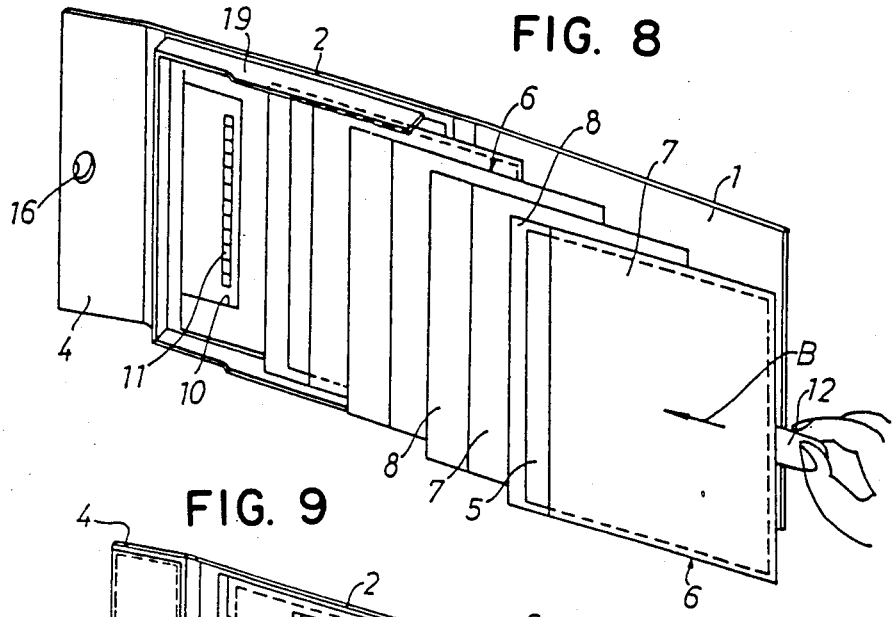
FIG. 8 is a perspective view of the third embodiment.
Figure 9:
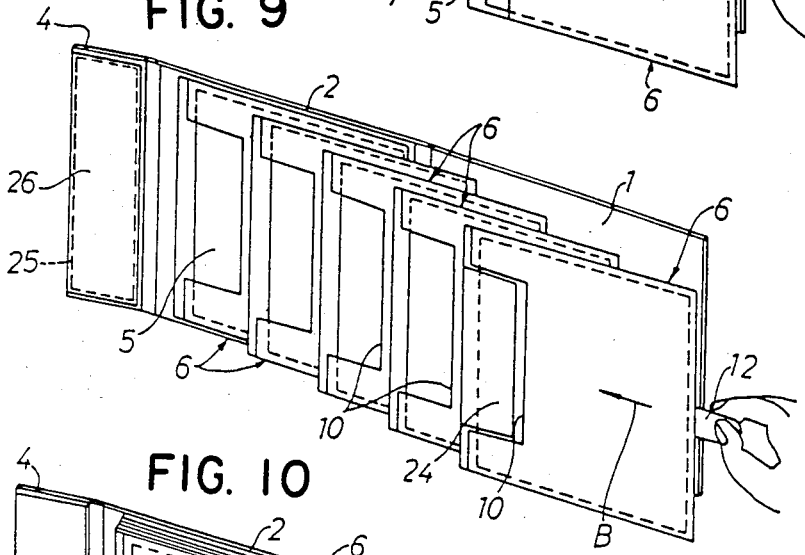
Figure 10:
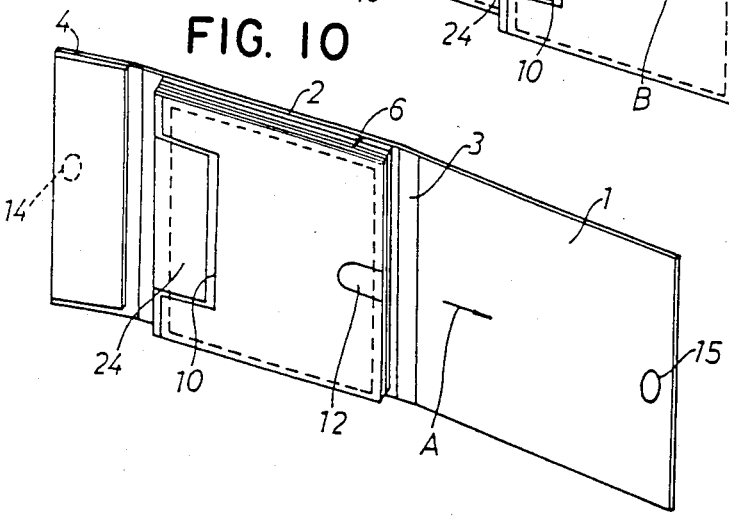

Referring now to FIG. 8, which illustrates the third embodiment of the present invention, an enclosure 19 is provided on the back cover 2. The enclosure 19 is installed such that it surrounds all the sides of the bag 6 but the side nearer to the side of the front cover 1, its height being adapted to be identical to or slightly larger than the thickness of the stacked bags 6 into each of which the predetermined articles to be enclosed 5 are contained. For this reson, such a case does not cause the bags 6, which is in the state of being stacked, to be shifted, and minimumizes the opportunity of giving a damage to the articles to be enclosed 5, even if an external force in a stacking direction acts upon the bags 6, when storing the file. Furthermore, under such an arrangement, since the back sheet material 8 on the side of the opening section 9 is adapted to be extruded near to the opening direction than the front sheet material 7, the index of the article to be enclosed 5 gets easier to discern.

Figures 11, 12, 14:
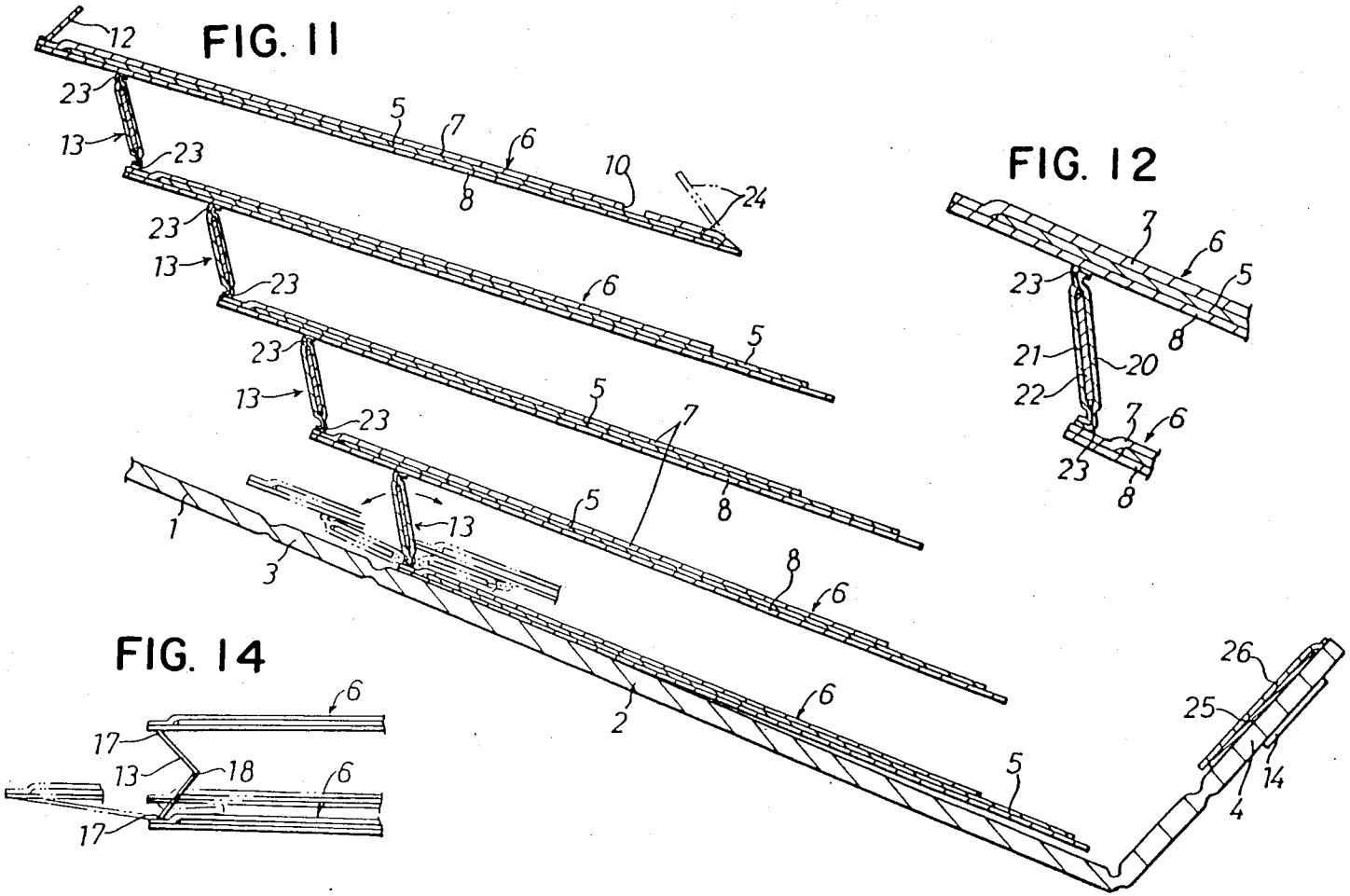

FIGS. 9 to 12 illustrate the fourth embodiment of the present invention, in which the connecting part 13 is provided on the side opposite to the opening section 9 of the bag 6. In that case, while with respect to the lower bags 6, the connecting parts 13 are welded to be combined with the end edge opposite to the opening section 9 thereof, with respect to the upper bags 6, the connecting parts 13 are welded to be combined with the position being distant from the end edge thereof near to the side of the opening section 9 by a dimensional portion of the connecting part 13. The connecting part 13 comprises, as shown in FIG. 12, the arrangement in which while two sheets of sheet materials 20 and 21, made of soft synthetic resin, are welded on their peripheral section in a bag like manner, a reinforcing paper 22 is inserted into their inside. For this reason, under the state of unfolding the file, the upper and lower bags 6 are ensured to be shifted by the distance between the two inflexion portions 23 formed on both the ends of the reinforcing paper 22 constituting the connecting part 13, thereby making the retrieval easier. As for the uppermost bag 6, a sealing piece 24 corresponding to the notched part 10 of the front sheet material 7 is provided on the back sheet material 8. This sealing piece 24 comprises a transparent sheet which is made of the soft synthetic resin. In order to be able to insert an memorandom 25 and the like on which a tile is referred to, the presser 4 is provided with a transparent bag portion 26 which is made of the soft synthetic resin sheet.

Figures 13, 15:
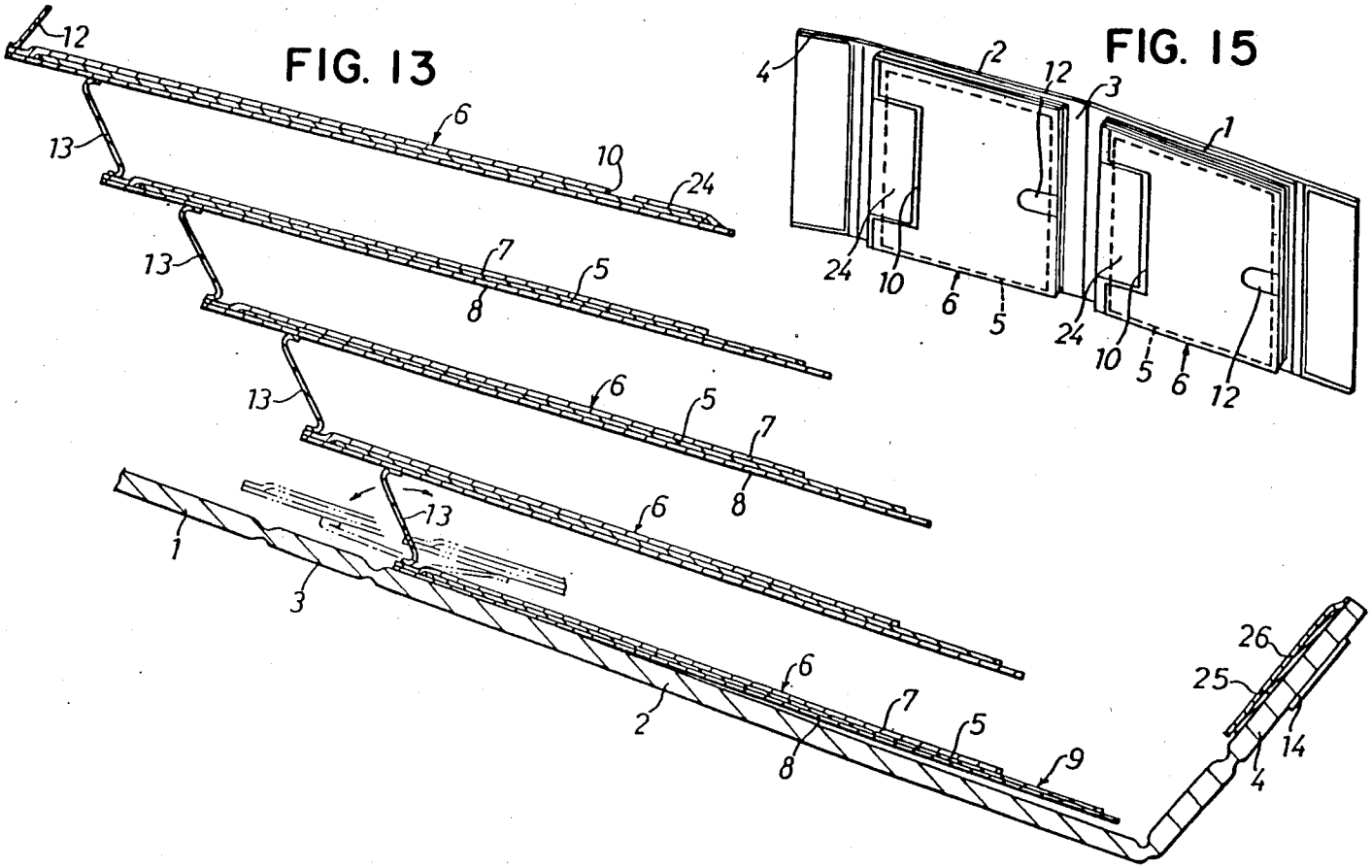
FIG. 13 is an expanded sectional view of the fiveth embodiment.
FIG. 15 is a perspective view of the seventh embodiment.

As shown in FIG. 13 illustrating the fiveth embodiment of the present invention, it is also possible that as the connecting part 13, the soft synthetic resin sheet material is used.

FIG. 14, illustrating the sixth embodiment of the present invention, shows the case where it is also possible to use the connecting part 13 possessing the inflexion portions 17 and 18 on three points thereof. At that time, the connecting part 13 can be welded to be combined with the end edge opposite to the opening section of the bag 6.

Referring finally to FIG. 15 illustrating the seventh embodiment of the present invention, it is also possible that the bags 6 are provided on both the sides respectively including the front cover 1 and the back cover 2.

Although the afore-mentioned embodiments put a light on the illustrated example in which the width of the connecting part 13 is slightly more narrow than that of the bag 6, the actual mode is not limited to that and it is possible to use a tape-shaped or rope-shaped connecting part 13. Furthermore, the material for the bag 6 and the connecting part 13 is not limited to the embodiments. The lowest bag 6 may be combined with the backbone 3.

POSSIBILITY OF INDUSTRIAL APPLICATION

The present invention according to the present invention is suitable for enclosing and storing the sheetlike articles to be enclosed such as the magnetic disk, the document and the like, being particularly convenient to the ones needing the retrieval.

What is claimed is:

1. A file comprising a front cover and a back cover which are connected unfoldably with a backbone; also comprising therebetween a plurality of bags, made of plastic having retentionability of its own shape, comprising a front sheet and a back sheet which are welded at respective three sides to form an opening section at a remaining side for sheet-like articles to be put in or out of the bags, said plurality of bags being adapted to stack with their sides aligned vertically, upon closing the front and back covers;

wherein the lowest bag in the stack is combined with its back sheet on the back cover of the file and adjacent bags in the stack are connected to one another by rectangular connecting sheets, made of flexible soft plastic in such a manner that a rectangular connecting sheet is welded with its one side on a back sheet of an upper bag in proximity of the upper bag opening section while the rectangular connecting sheet is welded with the other side on a front sheet of a lower bag with an approximate length of rectangular connecting sheet away from the opening section and wherein a knob is provided on the uppermost bag at its side opposite to the opening section for pulling the bags thus connected out in a direction opposite to the opening section such that the folded bags extend in tiers whereby opening sections of the lower bags are exposed and the opening sections of the front sheets of respective bags are provided with notched parts.

2. A file as defined in claim 1, wherein an anti-static agent is mixed in plastic material of the front and back sheets of respective bags.

3. A file as defined in claim 1, wherein the back sheet of the lowest bag is welded with the back cover at a portion corresponding to the notched part of the front sheet.

4. A file as defined in claim 1, wherein a hook portion for suspension is provided on the back cover at its side opposite to the backbone.

5. A file comprising a front cover and a back cover which are connected unfoldably with a backbone; also comprising therebetween a plurality of bags, made of plastic having reten-tionability of its own shape, comprising a front sheet and a back sheet which are welded at respective three sides to form an opening section at a remaining side for sheet-like articles to be put in or out of the bags, said plurality of bags being adapted to stack with their sides aligned vertically, upon closing the front and back covers;

wherein the lowest bag in the stack is combined with its back sheet on the back cover of the file and adjacent bags in the stack are connected to one another by rectangular connecting sheets, made of flexible soft plastic in such a manner that a rectangular connecting sheet is welded with its one side on a front sheet of a lower bag in opposite to the lower bag opening section while the rectangular connecting sheet is welded with the other side on a back sheet of an upper bag with an approximate length of the rect-angular connecting sheet toward the opening section and wherein a knob is provided on the uppermost bag at its side opposite to the opening section for pulling the bag thus connected out in a direction opposite to the opening section such that the folded bags extend in tiers whereby opening sections of the lower bags are exposed and the opening sections of the front sheets of respective bags are provided with notched parts.

6. A file as defined in claim 5, wherein an anti-static agent is mixed in plastic material of the front and back sheets of respective bags.

7. A file as defined in claim 5, wherein the back sheet of the lowest bag is welded with the back cover at the side opposite to the opening section and the front section thereof is welded with the connecting part at the side opposite to the opening section.

* * * * *